US005938316A

United States Patent [19]

Yan

[11] Patent Number: 5,938,316

[45] Date of Patent: Aug. 17, 1999

[54] ENHANCED SAFETY RETROFIT SYSTEM FOR LUMINARIA

[76] Inventor: Ellis Yan, 29 Annandale Dr., South Russell, Ohio 44022

[21] Appl. No.: 08/980,564

[22] Filed: Dec. 1, 1997

[51] Int. Cl.[6] ..... F21S 5/00

[52] U.S. Cl. ..... 362/260; 362/216; 362/431; 362/414; 362/265

[58] Field of Search ..... 362/263, 265, 362/260, 226, 216, 431, 410, 414

[56] References Cited

U.S. PATENT DOCUMENTS

| | | | |
|---|---|---|---|
| 4,141,061 | 2/1979 | Ford et al. | 362/216 |
| 4,278,911 | 7/1981 | Metoff | 362/216 |
| 4,549,252 | 10/1985 | Ripley et al. | 362/216 |
| 4,604,552 | 8/1986 | Alley et al. . | |
| 5,087,861 | 2/1992 | Boyd et al. . | |
| 5,187,411 | 2/1993 | Boyd et al. . | |
| 5,260,678 | 11/1993 | Van Wagener . | |
| 5,286,216 | 2/1994 | Volz . | |
| 5,351,174 | 9/1994 | Ewing | 362/226 |
| 5,580,161 | 12/1996 | Vakil et al. | 362/216 |

*Primary Examiner*—Thomas M. Sember
*Attorney, Agent, or Firm*—Joseph H. Taddeo

[57] ABSTRACT

An enhanced safety system for the conversion of luminaria that uses halogen lighting technology to a safe and efficient fluorescent lighting system. Quartz halogen bulbs operate at elevated temperatures and pressures. Fires have been known to have been started when a lighting fixture is accidentally toppled where some combustible material is in close proximity. This novel retrofit system provides for the safe and efficient operation of torchiere uplighted lighting systems. By retrofitting a lighting fixture to a fluorescent lamp using this adapter, there is an immediate benefit in reduced operating cost. For the equivalent light output, there can be a cost savings reduction by a factor of six or seven to one.

14 Claims, 3 Drawing Sheets

ENHANCED SAFETY RETROFIT SYSTEM FOR LUMINARIA

FIELD OF INVENTION

The present invention relates in general to an enhanced safety system for the conversion of luminaria that uses halogen lighting technology to a safe and efficient fluorescent lighting system, and more particularly to a novel retrofit system for the safe and efficient operation of torchiere uplighted lighting systems.

BACKGROUND OF THE INVENTION

One of the most recent innovations used in lighting today is the halogen technology that features Double Ended Quartz (DEQ) bulbs. The advantage of using these bulbs is that they provide crisp, white light which produces richer and more vibrant colors in room accent pieces. Another advantage in using this new technology is that these bulbs generate more light than comparable wattage incandescent lamps, thereby resulting in some cost savings, when there is a need for using high intensity illumination.

Presently, these bulbs are designed for use in today's most contemporary lighting fixtures. They are commonly used in torchieres, uplighted fixtures, wall sconces, and chandeliers, as well as in outdoor lighting fixtures.

Because these bulbs operate at high temperatures and pressure and may shatter, there are several elements of safety that must be observed. It is generally recommended that the bulb be used in an enclosed fixture to protect persons and surroundings from hot flying fragments, in the event of a catastrophic failure of the bulb. Torchieres and uplighted fixtures, for example, are manufactured with the high intensity bulb being fully exposed with some having a small shroud to deflect the flying debris toward the bottom of the reflector.

Frequently, accidental fires in the home or office are started when the luminiare is placed to close to hanging decorative items, such as the foliage of small imitation ornamental trees or curtains flowing across the top of the torchiere reflector by a breeze.

Other precautions that must be made by the user when using luminaria having halogen bulbs are:

1) The luminaria should not be used if the bulb is scratched or broken because it may break during installation or while operating, thereby causing either a fire or personal injury.

2) The halogen bulb operates at high temperatures. Touching the lamp while operating will burn one's skin. Gloves should be worn while replacing the bulb, only after a sufficient amount of time is allowed for cooling.

3) The luminaria should not be used by those who are sensitive to short wave ultra-violet radiation. Slight ultraviolet radiation from unprotected sources can cause skin and eye irritation following direct exposure. Passing the light through ordinary glass or plastic, such as wearing eye glasses, provides adequate protection.

4) When replacing the halogen bulb, only the rated voltage and wattage should be used in the fixture. It is essential that the lamp should not be operated in lighting power systems that exceed 100% of the rated voltage. Over-voltage operation results in short life, increases chance of skin and eye irritation, and increases pressure and tendency to break 5) The halogen bulb should not be used when in close proximity to combustible material or objects sensitive to drying or fading.

6) The halogen bulb should not be used when near liquids. The inadvertent splashing of a liquid on the bulb may cause it to shatter due to thermal shock caused by rapid cooling.

7) Deterioration of the lamp's socket contacts may adversely affect the bulb's performance. The socket should be replaced if deterioration is observed.

8) If the halogen bulb is touched by one's bare hands, the bulb should be cleaned with denatured alcohol to prevent incipient failure.

9) It is important that the halogen bulb be operated only in a horizontal position, plus or minus four degrees.

10) When replacing a halogen bulb with another, the following instructions should be observed:

a) Turn the power off and allow the bulb to cool before attempting to replace it.

b) Use gloves and eye protection when removing and installing bulbs.

c) Do not touch the new bulb with bare hands. Clean the bulb with denatured alcohol if it has been touched.

d) Firmly seat the bulb into the socket that is found at each end within the light fixture.

There is presently no method available to retrofit and dedicate an existing lighting fixture to a safer operating lamp, that is exceptionally more efficient in operation. Because of the many hazards and precautions that are necessary when using halogen bulbs, there is a particular need for a dedicated conversion system that will provide reliable, safe and efficient operation. In this regard, this invention fulfills this need.

SUMMARY OF THE INVENTION

The present invention is a retrofit system for the conversion and dedication of a luminaire that uses an unsafe halogen quartz bulb, as used in torchiere lighting fixtures and other luminaria, to a safe operating circular fluorescent lamp. The size of the halogen bulbs that are used in present day lighting equipment is typically 300 watts.

Because these bulbs operate at much higher temperatures than equivalent sized fluorescent or incandescent bulbs, they present a high risk for starting a fire in a home or office.

For example, if drapes blow across and land upon the top of an open torchiere fixture or, if there is any dangling foliage from a flammable imitation tree in close proximity to the top of the fixture, the setting presents essentials for creating a dangerous fire. Also, if the fixture accidentally topples over while operating, a serious fire can result. One such fire occurred when a pet brushed against the fixture, toppling it over onto a bed, where the bed linens caught fire.

When comparing the relative merits of the various common sources of illumination, such as the fluorescent, halogen and incandescent lamps, with each having the same equivalent wattage, the performance of the fluorescent lamp excels in longevity, low cost, efficient operation and in output illumination. Consider the following comparisons, where each lamp is rated at 40 watts.

The standard 40 watt incandescent bulb lasts about 300 hours and has an output of 450 lumens. A ruggedized 40 watt incandescent bulb lasts 1000 hours, but it has a lower light output—360 lumens, because of a thicker gage filament.

A halogen 40 watt quartz bulb has an improved longevity of about 2000 hours, but it has only a very slight improvement in light output—500 lumens.

The 40 watt fluorescent lamp, however, has tenfold improvement in longevity over the incandescent lamp and a fivefold improvement over the halogen lamp, about 10,000 hours. The same fluorescent lamp provides more than six to seven times increase in light intensity—to approximately 3000 lumens. For equivalent light output, the fluorescent lamp uses 14 percent of the input power that is needed by the halogen lamp.

Fluorescent lamps are made in a variety of wattages and shapes. Both halogen lamps and incandescent bulbs are inefficient in operation, especially when compared to a fluorescent lamp that uses substantially less input energy to produce the same equivalent light output.

A preferred embodiment of the present invention includes the use of a circular fluorescent lamp that has an adapter mountable to the base of the circular lamp assembly. The adapter is designed to be installed into the existing holes that are used to mount the halogen bulb socket receptacles.

The benefits in using a fluorescent lamp in place of a halogen bulb in an open uplighted fixture are; safer operation, thereby reducing the risk of fire, substantially longer life, much greater lighting intensity and a reduction of operating costs.

It is therefore an object of the present invention to provide a retrofit system for luminaria to convert from halogen bulb technology to fluorescent lamp operation.

It is another object of the present invention to provide a retrofit system for luminaria that promotes safe operation to prevent damage to one's home or office by fire.

It is still another object of the present invention to provide a retrofit system for luminaria that operates more efficiently, thereby reducing the cost of operation and maintenance.

These and other advantages of the present invention will become more apparent upon further reading of the detailed specification. It should be understood that deviations or modifications can be made without deviating or departing from the spirit of the present invention.

Figure 4:
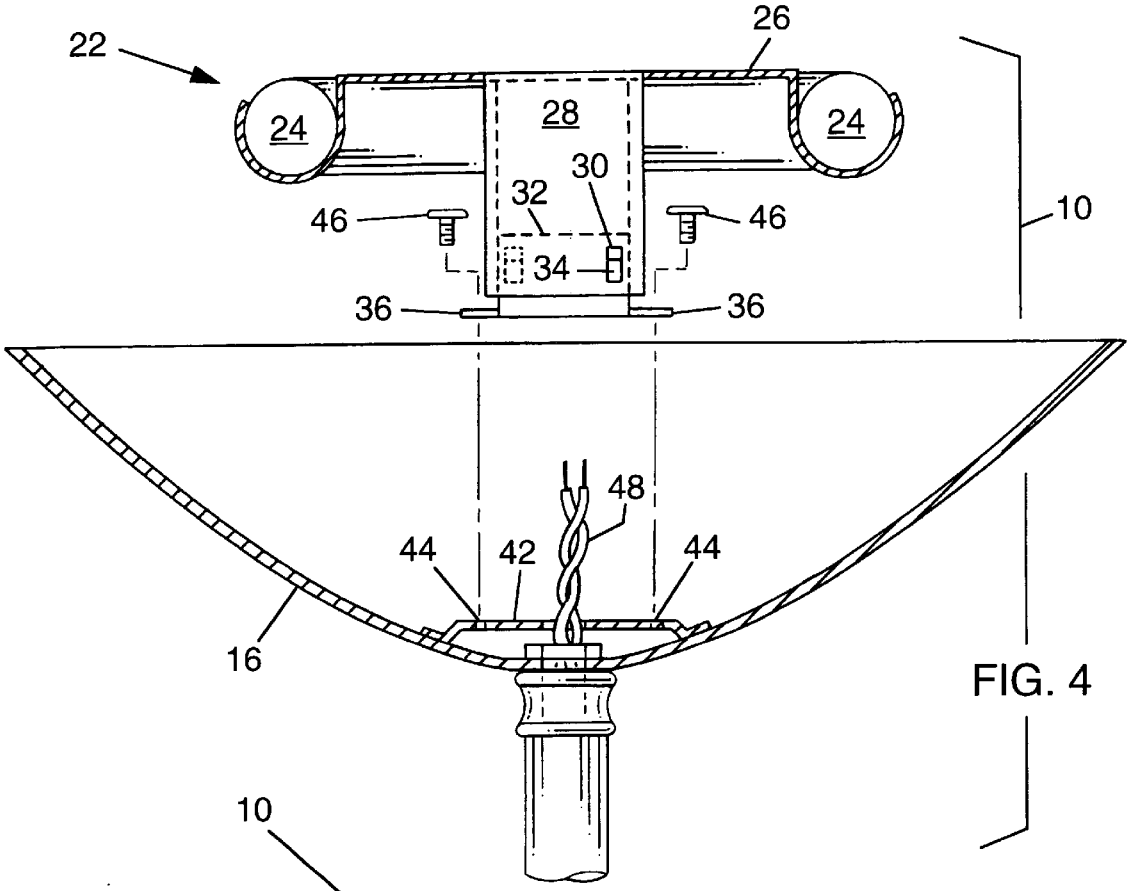

Shown in FIG. 4 is an exploded cross-sectional view of the fluorescent lamp assembly retrofitting the halogen lamp and sockets.

Figure 5:
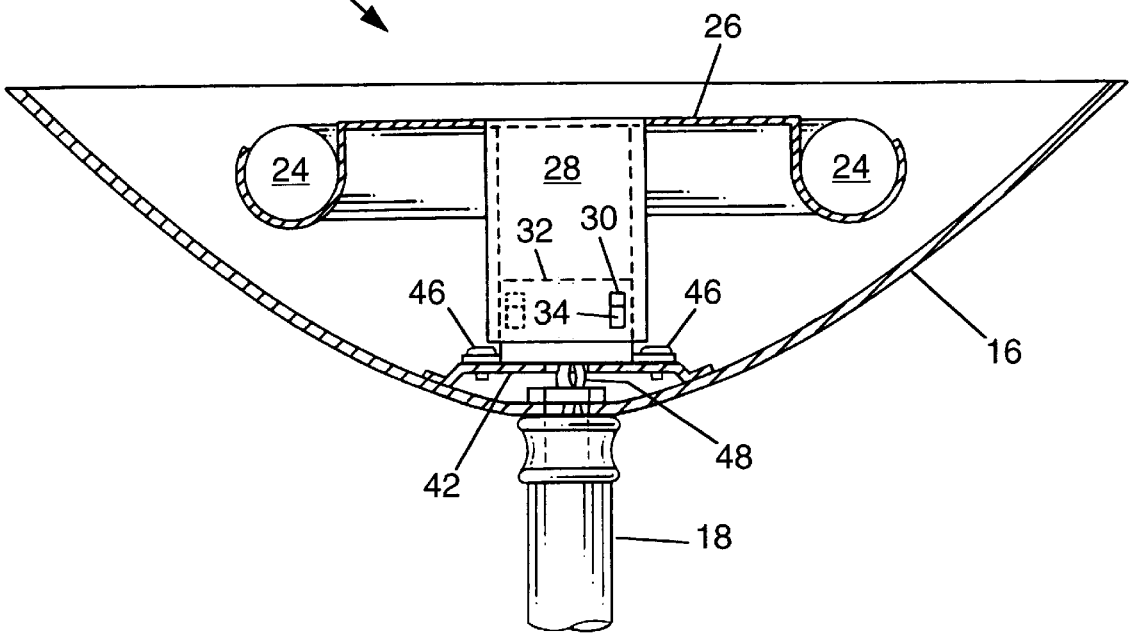

Illustrated in FIG. 5 is the completed sectional view of a torchiere lighting fixture after removing the halogen sockets and bulb assembly and retrofitting with the fluorescent lamp assembly.

DETAILED DESCRIPTION OF THE PREFERRED EMBODIMENT

The present invention details a retrofit system for the conversion of a luminaire, such as a torchiere, from using an unsafe halogen bulb to using a safe reliable fluorescent lamp. Halogen lamps have been responsible for causing fires, especially when the fixture is accidentally knocked over and lies near some combustible material.

Incandescent bulbs are still widely used and accepted as the standard in the lighting industry, even though it has several drawbacks. These bulbs are not energy efficient creating much heat while in operation and are not long lasting, having a short life.

Halogen bulbs are slightly greater in efficiency than the incandescent bulb, but operate at much higher temperatures for the same light output.

Fluorescent lamps on the other hand are the most energy efficient lighting system, where they are widely used in factories, stores and office buildings. The most common fixture in use accepts tubes that are either four feet or eight feet in length.

Even though the initial cost of the fluorescent bulb may be greater, it usually quickly offsets this cost through its efficient operation. A fluorescent lamp uses about one seventh the amount power used by either the incandescent or halogen bulb.

The present invention will now be described in detail in accordance with the referenced drawings.

Figure 1:
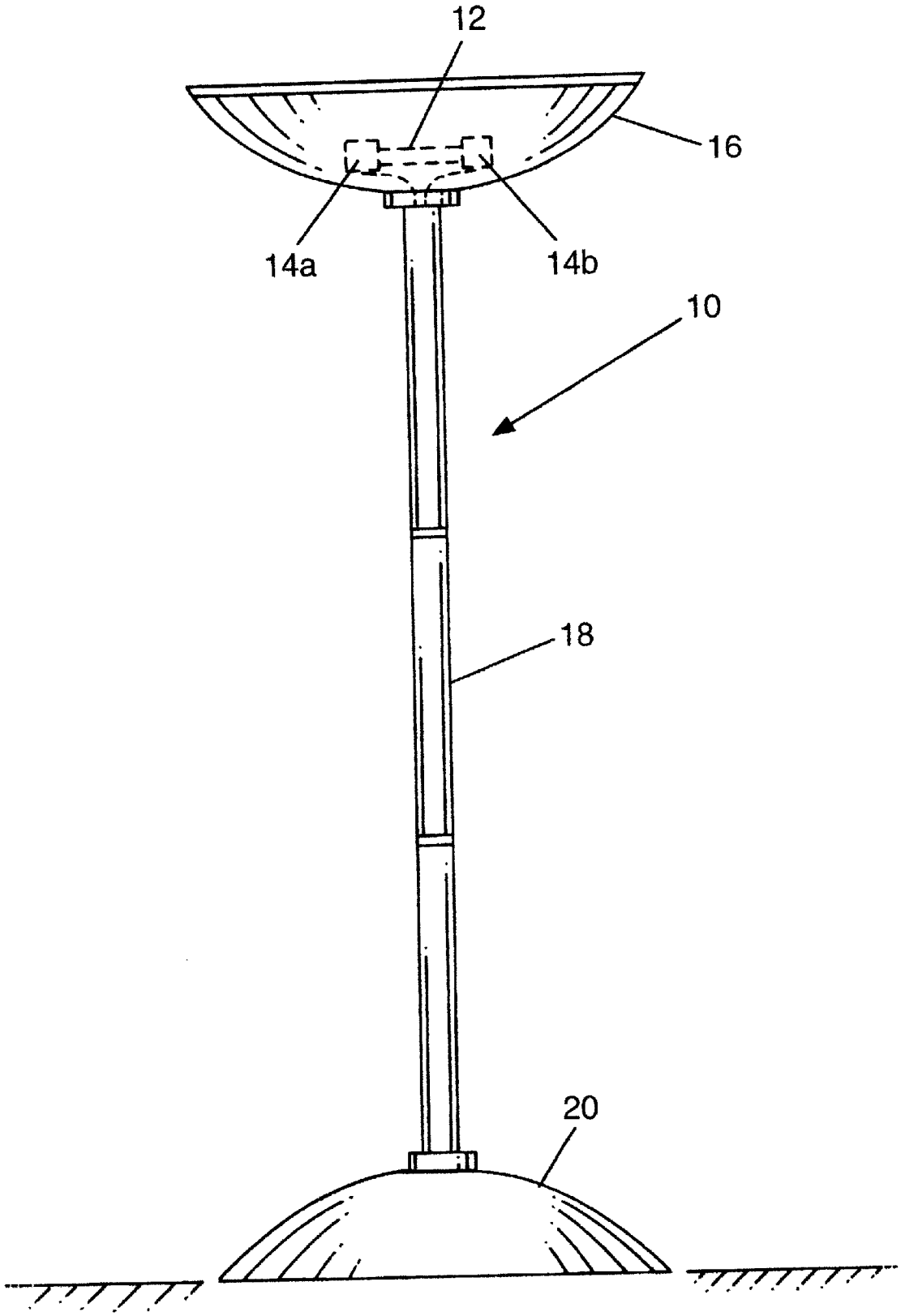
FIG. 1 is a side elevation of a typical complete luminaire, being a torchiere styled lamp, having a weighted base, a rising columnar support, a reflector and a halogen bulb.

Referring now to FIG. 1 of the drawings, illustrated is a typical luminaire floor lamp, being styled as the type of a torchiere 10. Located at the center of the uplight reflector 16 are the halogen lamp sockets 14 that engage the halogen lamp 12. The reflector 16 is retained in the center by support columnar post 18. The bottom of columnar post 18 threads into the weighted base 20.

Figure 2:
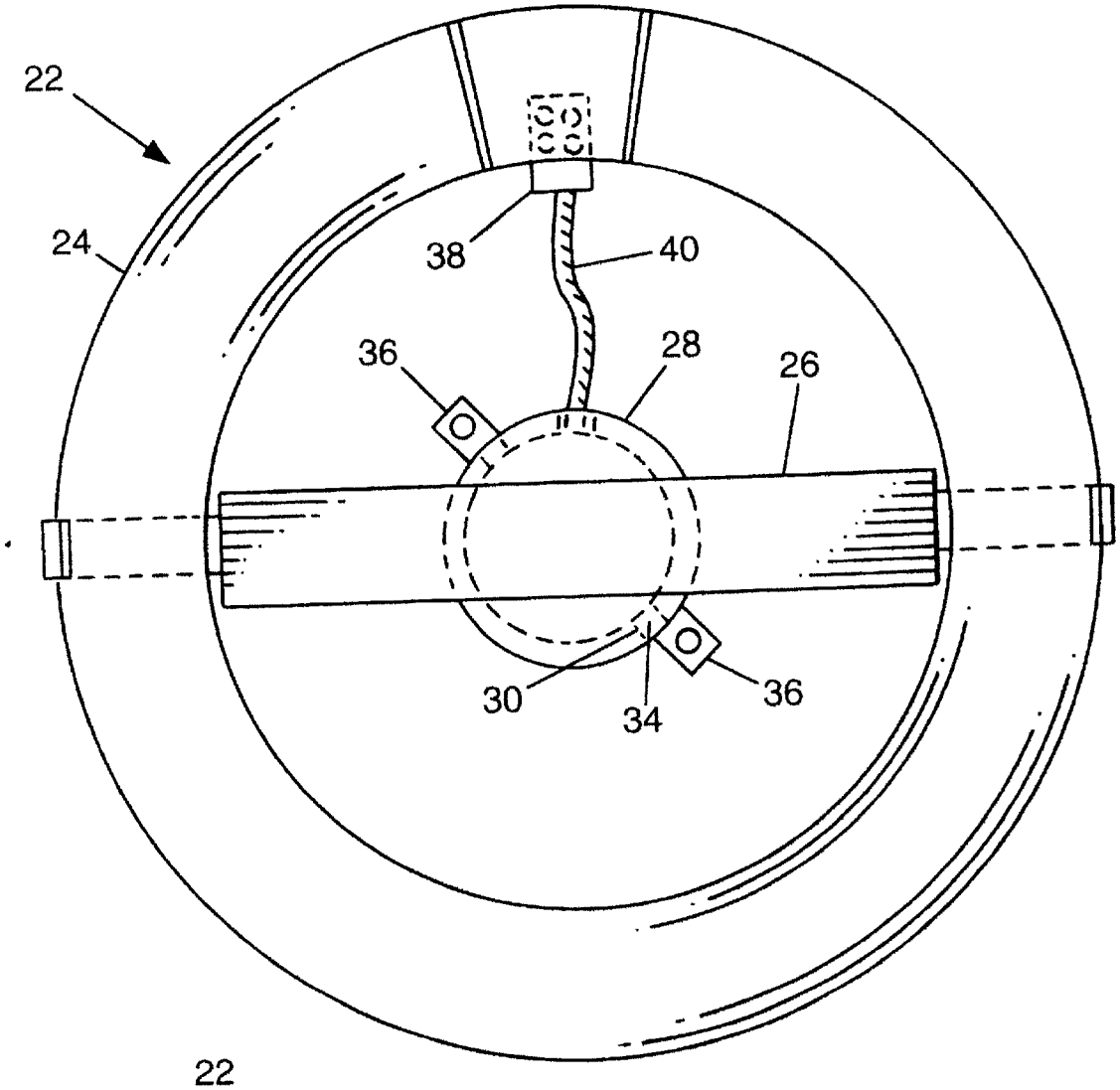
FIG. 2 is a top view of the fluorescent lamp assembly detailing the lamp support bracket and ballast housing.
Figure 3:
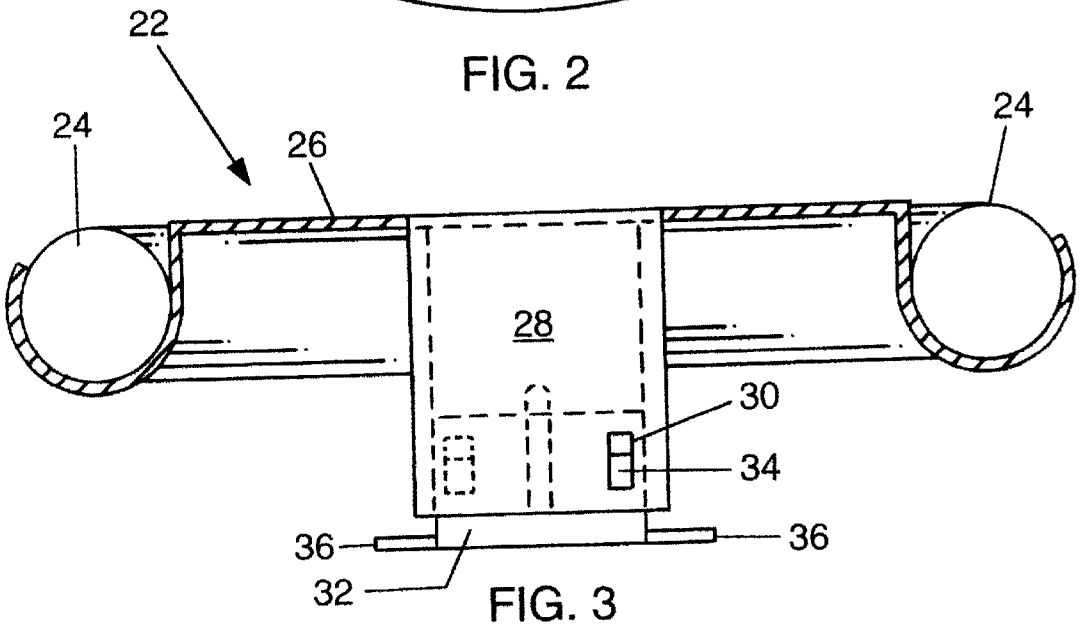
FIG. 3 is a side cross-sectional view of the fluorescent lamp assembly detailing the lamp support bracket and ballast housing.

Shown in FIGS. 2 and 3 is the adapter assembly 22 that holds circular fluorescent lamp 24. The fluorescent lamp that is used in the preferred embodiment is a 22 W circular lamp, such as a GE Kitchen and bath lamp—FC8T9-KB.

The adapter assembly 22 is comprised of a horizontal lamp retaining bar 26 that is secured to the ballast housing 28. The ballast housing is sized so that it can hold a conventional inductive magnetic ballast or in the preferred embodiment, the lighter weight, reduced flicker, electronic ballast. The ballast housing has a pair of rectangular holes 30 that form an interlocking aperture that can receive the interlocking tabs 34 of the adapter base 32.

Turning now to FIG. 4, illustrated is an exploded sectional view of the upper portion of the torchiere lighting fixture 10. The halogen bulb 12 and its associated sockets 14*a* and 14*b* are carefully removed from reflector bowl 16, as shown previously in FIG. 1, after disconnecting the lamp cord that is supplying power to the sockets and after removal of the two 6-32 hold-down machine screws 46. The fluorescent lamp 24 is carefully removed from the adapter assembly 22, after disconnecting interconnecting cable 40 by removal of the four-pronged plug 38. The adapter base 32 is disassembled from the ballast housing 28 by depressing interlocking tabs 34 toward each other. The power-cord 48 is subsequently wired to the electronic ballast using wire-nuts. The adapter assembly is then lowered into reflector 16, while aligning the holes in the tabs 36 with the threaded holes 44, found in the bracket 42. Bracket 42 is normally spot welded in the lower central portion of reflector 16. Two 6-32 pan head machine screws 46, secure the adapter assembly to bracket 42.

The assembly is finalized by snapping the ballast compartment 28 onto the adapter base 32, while engaging the interlocking tabs 34 into the rectangular aperture. The fluorescent lamp 24 is snapped into the lamp retaining bar 26. Completing the assembly is the insertion of the 4-pin plug to the pins on fluorescent lamp 24.

FIG. 5 details the integration of the completed assembly of the present invention into a typical torchiere lighting fixture. By using the adapter of the present invention, together with a companion circular fluorescent bulb, an enhanced safety lighting retrofit system provides a safe and efficient luminaire.

While specific embodiments of the present invention have been shown and described in detail to illustrate the principles of the invention, it should be understood the that other modifications or embellishments can be made without departing from the true spirit of the invention.

I claim:

1. A retrofit safety system for installation in a torchiere floor lamp of the type that includes an uplight relector attached to a support column supported by a weighted base, the reflector having a pair of halogen lamp sockets that are fixed on a reflector mounting bracket for engaging a halogen lamp powered from a lamp power cord, the retrofit system effective for conversion and dedication of a torchiere lamp that uses an unsafe halogen quartz bulb, to a safe operating lamp, comprising:

an adapter base, having outward projecting tabs, fixed on the bracket;

an adapter assembly including a ballast housing sized for holding a conventional inductive magnetic ballast, the housing having upper and lower portions with a pair of holes near the lower portion that form an interlocking aperture to receive corresponding tabs of the adapter base;

wherein the ballast housing includes a retaining bar projection that radiates outwardly from the housing;

wherein the retaining bar projection includes first and second terminal ends each end having an upward oriented U-shaped configuration;

wherein the U-shaped terminal ends comprises a flexible bulb snap retainer for retention of a circular flourescent lamp mounted in the snap retainer by finger pressure.

2. The retrofit safety system for use with a torchiere floor lamp of claim 1, wherein the reflector is shaped like a bowl having a rim, inner and outer surfaces and a center; and the bowl is fixed to the column near the center.

3. The retrofit safety system of claim 2, wherein the retaining bar radiates horizontally from the ballast housing, such that the florescent lamp mounted in the snap retainer, is suspended horizontally in the bowl.

4. The retrofit safety system according to claim 3, wherein the adapter assembly has a height dimension that is lower than the height of the bowl rim, whereby the florescent lamp is suspended within the outer surface of the bowl shaped reflector.

5. The retrofit safety system for use with a torchiere floor lamp as described in claim 4, further comprising a lamp interconnection cable terminating in an electric plug.

6. The retrofit safety system in claim 5, wherein the flourescent lamp comprises a circular shaped cylinder with a circumference and the lamp interfits into the U-shaped snap retainers at any point on the circumference.

7. The retrofit safety system according to claim 6, the flourescent lamp further comprising a socket to receive the interconnection cable plug.

8. The retrofit safety system for use with a torchiere floor lamp as described in claim 7, wherein the flourescent lamp communicates with the lamp power cord through the ballast, ballast cable and plug.

9. The retrofit safety system of claim 8, wherein the column is threaded into the base.

10. The retrofit safety system of claim 9, wherein the bracket is welded on the inner surface, near a lower portion of the bowl reflector.

11. The retrofit safety system of claim 10, wherein the bracket includes a pair of fastener holes therethrough, the adapter base mounting tabs also having corresponding holes therethrough; and, the adapter assembly is secured to the reflector with fasteners using said bracket holes previously employed in securing the halogen bulb sockets to the reflector.

12. A method for retrofitting a safety system in a torchiere floor lamp of the type that includes a halogen lamb assembly with an uplight relector centrally fixed on a support column threaded into a weighted base, the reflector having centered therein halogen lamp sockets that are fixed on a reflector mounting bracket and engage a halogen lamp powered by a lamp power cord, to achieve the conversion and dedication of the torchiere lamp that uses an unsafe halogen quartz bulb, to a safe operating fluorescent lamp, comprising the steps of:

providing an adapter assembly for the torchiere floor lamp, including:

an adapter base, having outward projecting tabs, fixed on the bracket;

a ballast housing sized for holding a conventional inductive magnetic ballast, the housing having upper and lower portions with a pair of holes near the lower portion that form an interlocking aperture to receive corresponding tabs of the adapter base;

wherein the ballast housing includes a retaining bar projection that radiates outwardly from the housing;

wherein the retaining bar projection includes first and second terminal ends each end having an upward oriented U-shaped configuration;

wherein the U-shaped terminal ends comprises a flexible bulb snap retainer, for retaining a circular flourescent lamp mounted in the snap retainer by finger pressure;

removing the halogen lamp assembly from the torchiere lamp; and, inserting the fluorescent adapter assembly and circular fluorescent bulb retained therein.

13. A method according to claim 12, wherein the removing the halogen lamp assembly step includes the steps of:

disconnecting the lamp cord that is supplying power to the sockets;

removing the halogen bulb and its associated sockets from reflector bowl;

removing the hold-down machine screws;

disconnecting the interconnecting cable by removal of the four-pronged plug;

removing the fluorescent lamp from the adapter assembly; and, dis-assembling the adapter base from the ballast housing by depressing interlocking tabs toward each other.

14. A method according to claim 13, wherein the inserting the fluorescent adapter assembly and circular fluorescent bulb step includes the steps of:

wiring the power-cord to the electronic ballast;

lowering the adapter assembly into the reflector;

aligning the holes in the adapter base tabs with the threaded holes in the bracket;

securing the adapter assembly to the bracket;

snapping the ballast compartment onto the adapter base while engaging the interlocking tabs into the rectangular aperture;

securing the fluorescent lamp with snap-locking the lamp into the lamp retaining bar;

inserting the 4-pin plug to the pins on the fluorescent lamp for electrical interconnection of the florescent lamp with the torchiere lamp power cord.

* * * * *